US010530059B2

(12) United States Patent
Wang et al.

(10) Patent No.: US 10,530,059 B2
(45) Date of Patent: Jan. 7, 2020

(54) FOLDING DIPOLE ANTENNA, WIRELESS COMMUNICATION MODULE AND METHOD OF CONSTRUCTING THE SAME

(71) Applicant: Tyco Electronics (Shanghai) Co. Ltd., Shanghai (CN)

(72) Inventors: Shaoyong Wang, Shanghai (CN); Yuming Song, Shanghai (CN); Feng Dai, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 116 days.

(21) Appl. No.: 15/677,450

(22) Filed: Aug. 15, 2017

(65) Prior Publication Data

US 2018/0026375 A1 Jan. 25, 2018

Related U.S. Application Data

(63) Continuation of application No. PCT/IB2016/050782, filed on Feb. 15, 2016.

(30) Foreign Application Priority Data

Feb. 15, 2015 (CN) ..... 2015 1 0084101

(51) Int. Cl.
*H01Q 9/26* (2006.01)
*H01Q 9/28* (2006.01)
(Continued)

(52) U.S. Cl.
CPC ..... *H01Q 9/285* (2013.01); *H01Q 1/24* (2013.01); *H01Q 1/243* (2013.01); *H01Q 9/26* (2013.01); *H01Q 19/108* (2013.01)

(58) Field of Classification Search
CPC ..... H01Q 19/108; H01Q 1/24; H01Q 1/38; H01Q 9/16; H01Q 9/26; H01Q 1/243; H01Q 9/285
See application file for complete search history.

(56) References Cited

U.S. PATENT DOCUMENTS 2,324,462 A * 7/1943 Leeds ..... H01Q 9/26 343/742
2,978,703 A * 4/1961 Kuecken ..... H01Q 9/26 343/793

(Continued)

FOREIGN PATENT DOCUMENTS

JP 2006135605 A 5/2006
JP 2012049864 A 3/2012
WO 2006109184 A1 10/2006

OTHER PUBLICATIONS

PCT Written Opinion and Search Report, dated May 17, 2016, 13 pages.

(Continued)

*Primary Examiner* — Tho G Phan
(74) *Attorney, Agent, or Firm* — Barley Snyder

(57) ABSTRACT

A folding dipole antenna, a wireless communication module in which folding dipole antenna is incorporated, and methods for constructing the folding dipole antenna and the wireless communications module. The selection of the components of the folding dipole antenna and the wireless communication module and the arrangement of these components are such that wireless transmission performances are not or less affected by the installation positions on a home appliance.

14 Claims, 10 Drawing Sheets

(51) Int. Cl.
*H01Q 1/24* (2006.01)
*H01Q 19/10* (2006.01)

(56) References Cited

U.S. PATENT DOCUMENTS 3,344,431 A * 9/1967 Greenberg ..... H01Q 19/30
343/795
5,087,922 A * 2/1992 Tang ..... H01Q 21/062
343/795
5,724,051 A * 3/1998 Mailandt ..... H01Q 9/16
343/795
5,754,143 A * 5/1998 Warnagiris ..... H01Q 1/36
343/746
8,013,800 B2 * 9/2011 Zheng ..... H01Q 1/243
343/702
8,717,244 B2 * 5/2014 Joyce, Jr. ..... H01Q 1/2225
343/795
2004/0183739 A1 9/2004 Bisiules et al.

OTHER PUBLICATIONS

Abstract of JP2012049864, dated Mar. 9, 2012, 2 pages.
Abstract of JP2006135605, dated May 25, 2006, 2 pages.

* cited by examiner

FOLDING DIPOLE ANTENNA, WIRELESS COMMUNICATION MODULE AND METHOD OF CONSTRUCTING THE SAME

CROSS-REFERENCE TO RELATED APPLICATION

This application is a continuation of PCT International Application No. PCT/IB2016/050782 filed Feb. 15, 2016, which claims priority under 35 U.S.C. § 119 to Chinese Patent No. 201510084101.6 filed Feb. 15, 2015.

FIELD OF THE INVENTION

The present invention relates to a technical field of antenna, more particularly, relates to a folding dipole antenna, a wireless communication module, and a method of constructing the same.

BACKGROUND

By connecting internet home appliances to the Internet, interconnection among the home appliances, the Internet, and users is achieved. Generally, the home appliances may be connected to the Internet in a wire or wireless connection mode. The wireless connection mode is widely used because it avoids the complications of cables.

Since signals of the antenna are blocked by metal, a wireless communication module cannot be installed in a chamber enclosed by a metal housing. On the other hand, it is desirable to install the wireless communication module in any position of the home where the appliance as required. Generally, there are three ways to install the wireless communication module.

The antenna and the wireless communication module are made in the same printed circuit board (PCB) and installed in the home appliance. A portion of the housing of the home appliance near the wireless communication module is removed. Taking into account the robustness of the overall structure of the home appliance, it is impossible to remove too much metal. Thereby, the signal of antenna will become poor.

The wireless communication module is installed in the home appliance and the antenna is installed on the outer wall of the housing (or on the inner wall of the housing, in this case, it is also necessary to remove a portion of the housing). The antenna is connected to the wireless communication module by a radio-frequency cable. Obviously, using radio-frequency cable will increase the cost and the wireless signal loss.

The wireless communication module and the antenna are integrated into a single piece, installed on the outer wall of the housing of the home appliance, and connected to a main circuit board in the home appliance by a connector and cables. Way (3) has advantages of convenient installation, convenient updating, and excellent signals without being blocked. Hereinafter, the antenna in the wireless communication module installed in way (3) will be described.

There are many kinds and brands of home appliances, and these kinds and brands of home appliances have different sizes and shapes. Thereby, these wireless communication modules may be required to be installed on different positions on these home appliances, and the design of the antenna is very challenging.

For example, in prior art, there is solution to use inverted F antenna, planar inverted F antenna, monopole antenna and dipole antenna, widely used in mobile terminal equipment, for example, mobile telephone, as the antenna used in the internet home appliance. But these antennas each is a non-balanced antenna, therefore, a current is produced in the metal near the antenna in work, and its performance is affected by the metal housing of the home appliance. Even installed in the central or the corner of the home appliance, the performance of the antenna also varies greatly.

SUMMARY

A folding dipole antenna, constructed in accordance with the present invention, includes, first and second feed connectors, first, second, and third conductor segments, and first and second connection segments. The first feed conductor has an end thereof connected to a radio frequency signal receiving/transmitting terminal of a radio frequency processing circuit. The first conductor segment is connected to the other end of the first feed conductor. The second feed conductor has an end thereof connected to another radio frequency signal receiving/transmitting terminal or a ground terminal of the radio frequency processing circuit. The second conductor segment has a length substantially equal to the first conductor segment. Also, the second conductor segment is separated from the first conductor segment by the first feed conductor and the second feed conductor. Furthermore, the second conductor segment is connected to an end of the second feed conductor. The third conductor segment is connected in series between the first conductor segment and the second conductor segment and in parallel to a composite structure composed of the first conductor segment and the second conductor segment.

The first connection segment connects the first conductor segment and the third conductor segment. The second connection segment is connected to the second conductor segment and the third conductor segment. Also, the second connection segment has a length substantially equal to that of the first connection segment. Furthermore, the second connection segment is separated from the first connection segment by the first feed conductor and the second feed conductor.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENT(S)

Figure 1:
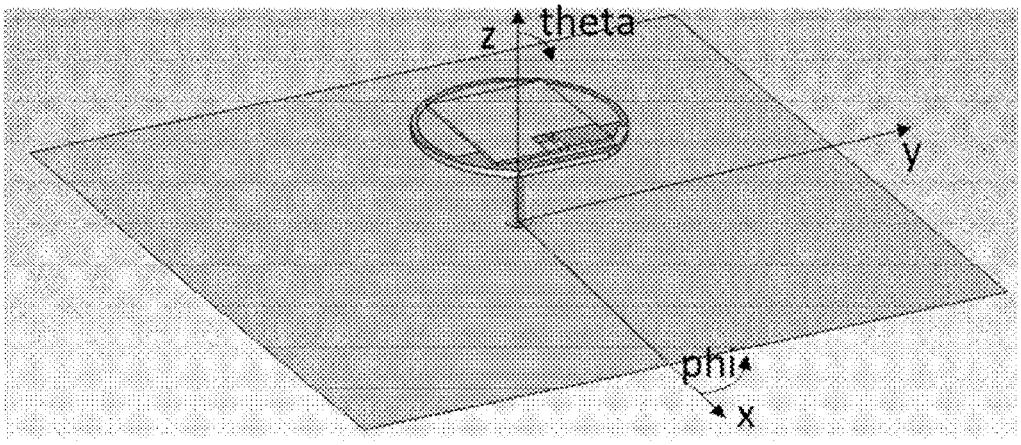
FIG. 1 shows the installing of a wireless communication module with a built-in IFA antenna on a metal housing of a home appliance.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiments set forth herein; rather, these embodiments are provided so that the present disclosure will be thorough and complete and will fully convey the concept of the invention to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the prior art, the performance of a built-in IFA antenna (and a wireless communication module) used in this art is greatly affected by the installation position of the antenna on the home appliance and the size of a metal plate on which the antenna is installed. This is shown in detail in FIGS. 1-6. In order to facilitate the description, herein, it will describe the antenna and the wireless communication module with a work frequency of 2.45 GHz. But the present invention is not limited to the antenna and the wireless communication module with the work frequency of 2.45 GHz. The present invention may be applied to the antenna and the wireless communication module with any work frequency.

FIG. 1 shows the installing of a wireless communication module with a built-in IFA antenna on a metal housing of a home appliance (for example, a refrigerator). As shown in FIG. 1, in order to clearly show the inside structure of the wireless communication module, a case of the wireless communication module is removed. In the following description of the present invention, a spherical coordinate system is used to describe the spatial characteristics of the antenna signal. As shown in FIG. 1, the symbol 'phi' represents a horizontal plane angle in the spherical coordinate system; the symbol 'theta' represents an elevation angle in the spherical coordinate system, and a positive direction of Y-axis in FIG. 1 represents an angle equal to zero degree.

Figure 2:
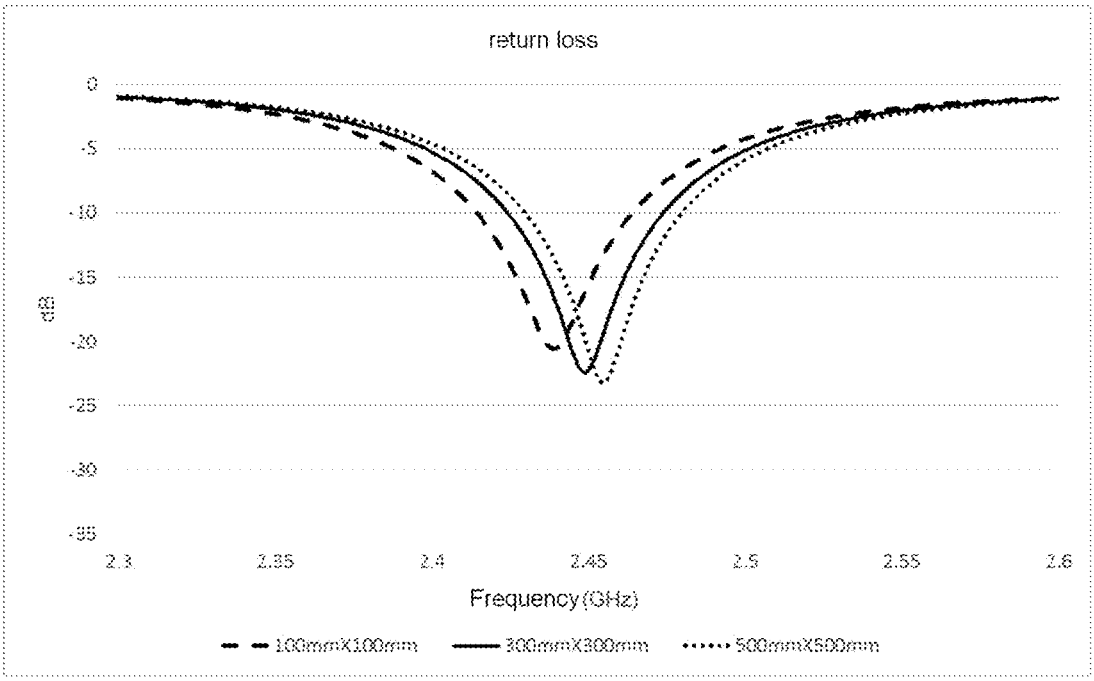
FIG. 2 shows return losses of the IFA antenna when it is placed on the centers of metal plates with different sizes.
Figure 3:
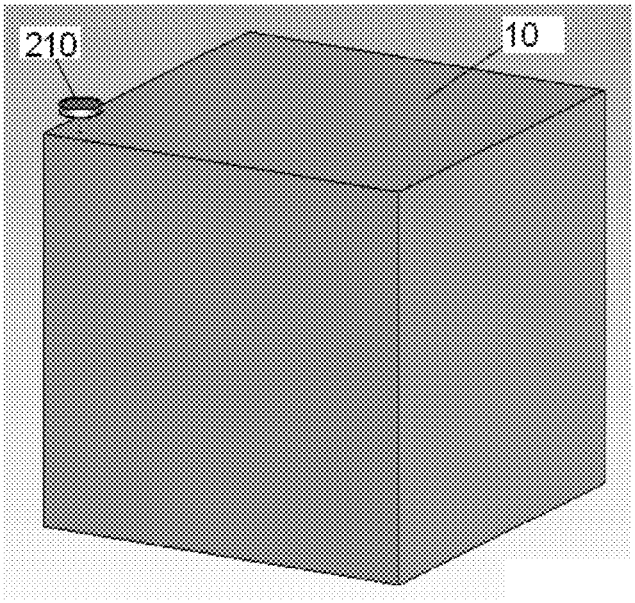
FIG. 3 shows the placing of the IFA antenna on the top corner of the metal housing with sizes of 300 mm×300 mm×300 mm.
Figure 4:
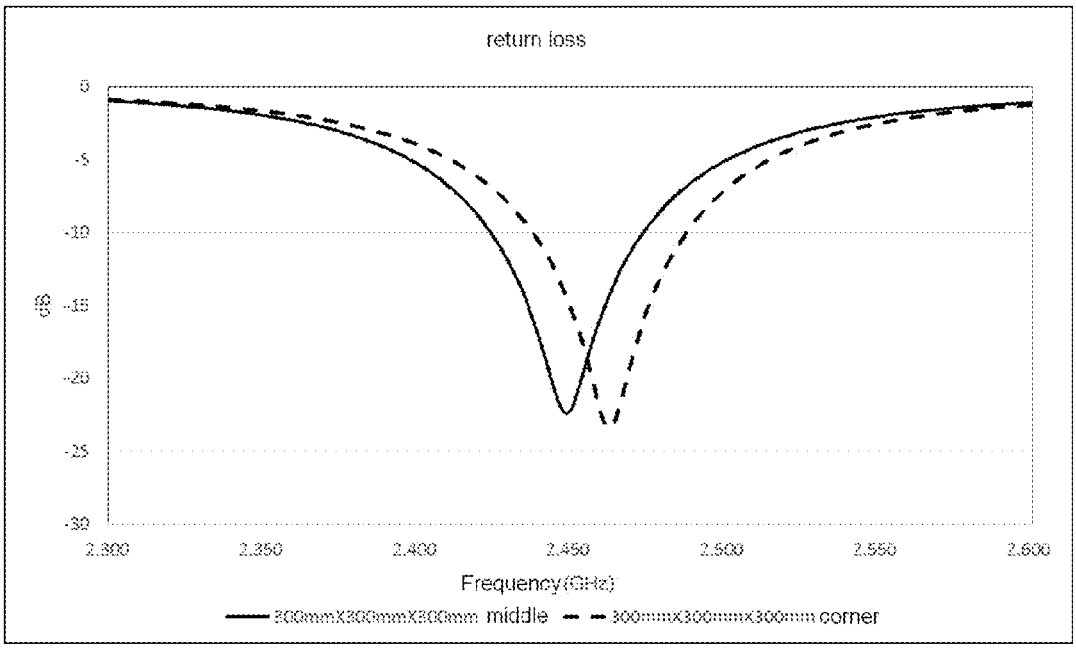
FIG. 4 shows return losses of the IFA antenna when it is placed on different positions of the metal housing with sizes of 300 mm×300 mm×300 mm.
Figure 5:
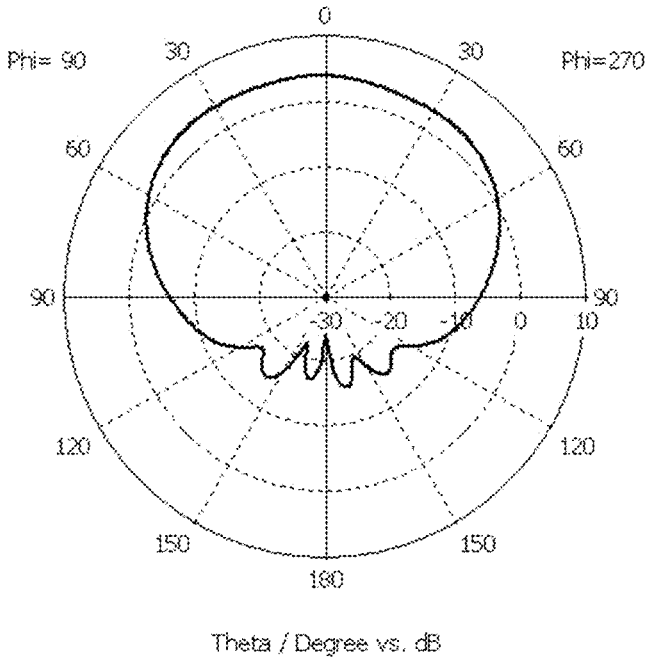
FIG. 5 is a diagram of a radiation direction of the IFA antennas placed on the top center of the metal housing with sizes of 300 mm×300 mm×300 mm.
Figure 6:
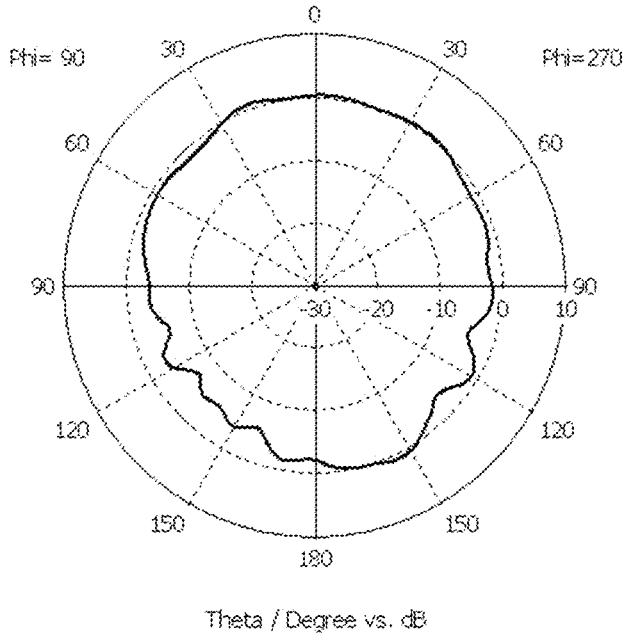
FIG. 6 is a diagram of a radiation direction of the IFA antennas placed on the top corner of the metal housing with sizes of 300 mm×300 mm×300 mm.

FIG. 2 shows return losses of the IFA antenna (and the wireless communication module thereof) when it is placed on the centers of metal plates with different sizes. FIG. 3 shows the placing of the IFA antenna 210 on the top corner of the metal housing 10 with sizes of 300 mm×300 mm×300 mm. FIG. 4 shows return losses of the IFA antenna when it is placed on different positions of the metal housing with sizes of 300 mm×300 mm×300 mm. FIG. 5 is a diagram of a radiation direction of the IFA antennas placed on the top center of the metal housing with sizes of 300 mm×300 mm×300 mm, in which the frequency point is equal to 2.45 GHz, the gain is equal to 3.98 dBi, and the 3 dB beam width is equal to 117.1 degrees. FIG. 6 is a diagram of a radiation direction of the IFA antennas placed on the top corner of the metal housing with sizes of 300 mm×300 mm×300 mm, in which the frequency point is equal to 2.45 GHz.

This shows that the antenna gain in the upper half space is reduced to 0.82 dB, the 3 dB beam width is 158.5 degrees, and the antenna gain in the lower half space is increased to 0.49 dB. When the antenna (wireless communication module) is placed on the corner of the metal housing, it shows that the antenna gain is decreased by −3.2 dB in the upper half space that is required to be covered by signal and a strong radiation appears in the lower half space that is not required to be covered by signal. In actual use, it will interferewith indoor electrical appliances or other home appliances.

Concerning the above, according to a general concept of the present invention, there is provided a folding dipole antenna, a wireless communication module, and a method of constructing the same.

In an embodiment of the present invention, the folding dipole antenna at least comprises: a first conductor segment; a first feed conductor with one end connected to the first conductor segment and the other end connected to a radio frequency signal receiving/transmitting terminal of a radio frequency processing circuit; a second conductor segment with a length equal to that of the first conductor segment; a second feed conductor with one end connected to the second conductor segment and the other end connected to another radio frequency signal receiving/transmitting terminal or a ground terminal of the radio frequency processing circuit; a third conductor segment; a first connection segment configured to connect the first conductor segment and the third conductor segment; and a second connection segment configured to connect the second conductor segment and the third conductor segment. The first connection segment is configured to have a length substantially equal to that of the second connection segment. The first conductor segment and the second conductor segment are separated by the first feed conductor and the second feed conductor. The third conductor segment is connected in series between the first conductor segment and the second conductor segment and parallel to a composite structure composed of the first conductor segment and the second conductor segment.

In an embodiment of the present invention, the wireless communication module at least comprises a housing, a radio frequency processing circuit provided in the housing, and the above folding dipole antenna provided in the housing and connected to the radio frequency processing circuit.

Figure 7:
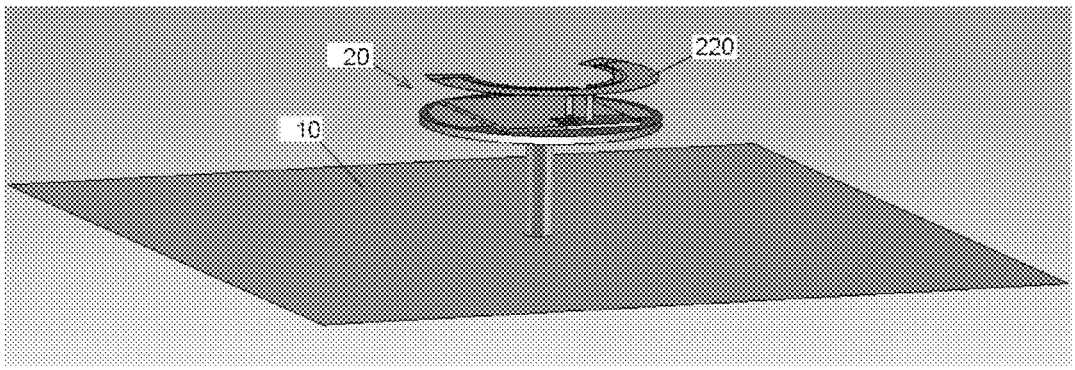
FIG. 7 shows a wireless communication module, in which an arc shaped folding dipole antenna is disposed installed on the metal housing of the home appliance.

FIG. 7 shows a wireless communication module 20, in which an arc shaped folding dipole antenna 220 is disposed, installed on the metal housing 10 of the home appliance according to an embodiment of the present invention. As shown in FIG. 7, in order to clearly show the inside structure of the wireless communication module, the housing of the wireless communication module is removed. But it is well known to those skilled in this art that the wireless communication module of FIG. 7 should have a housing for protecting the inside circuit and the antenna.

Figure 8:
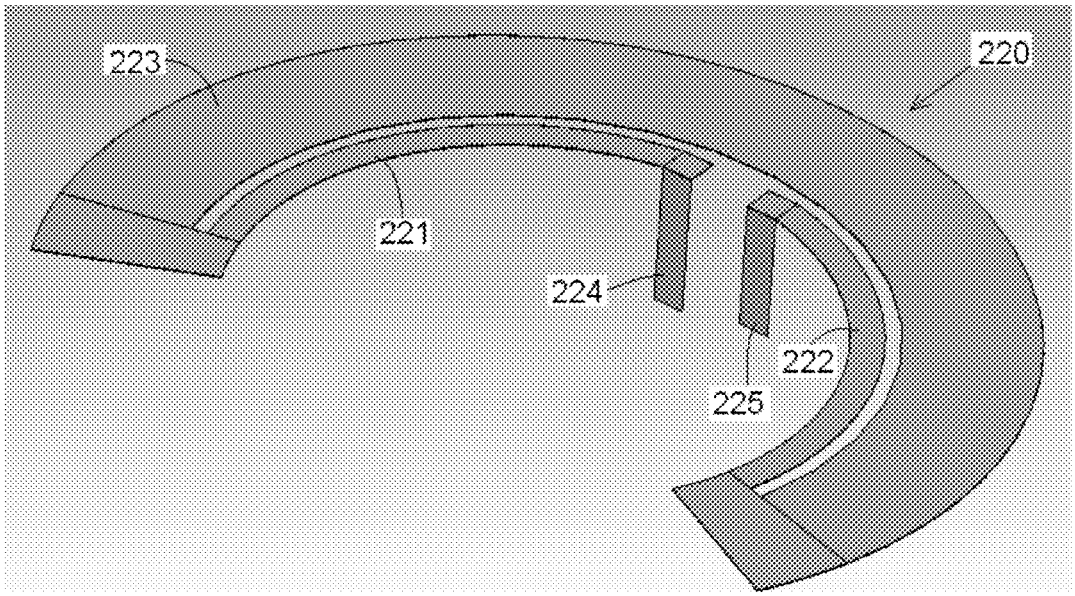
FIG. 8 shows a structure of the arc shaped folding dipole antenna of FIG. 7.

FIG. 8 shows a structure of the arc shaped folding dipole antenna 220 of FIG. 7.

As shown in FIGS. 7 and 8, a composite structure (an inner arc shown in FIG. 8) composed of a first conductor segment 221 and a second conductor segment 222 exhibits an arc shape. A third conductor segment 223 (an outer arc shown in FIG. 8) is configured as an outer arc that is concentric to the composite structure and has an arc sector angle equal to that of the composite structure.

As shown in FIG. 8, if the work frequency of the antenna is equal to 2.4 GHz, a total length of the inner and outer arcs and the connection segments between them is equal to about ½ wavelength of electromagnetic wave of 2.4 GHz, that is, about 62.5 mm. The antenna input impedance is varied with the changing of a width of the outer arc and the inner arc, a distance between them (or a length of the connection conductor segment), and a height of the arc surface relative to a ground surface thereof (for example, PCB below the arc surface in FIG. 8).

Generally, the input impedance decreases with the increase of the width of the outer arc and the inner arc and the input impedance bandwidth decreases with the decrease of the antenna height. Those skilled in this art may design parameters according to specific requirements, so as to produce the antenna input impedance matched with an output impedance of a radio frequency processing circuit (for example, a wireless RF chip used in the wireless communication module). In this way, it does not need to adopt passive components, for example, capacitance and inductance, to achieve the impedance matching. As shown in FIG. 8, two metal pins (feed points or the above first and second feed conductors 224, 225) perpendicular to the arc surface are provided to connect the first conductor segment 221 and the second conductor segment 222 to two radio frequency signal receiving/transmitting terminals of the radio frequency processing circuit (in a case where the radio frequency processing circuit uses the differential form of input/output), respectively, or connected to a radio frequency signal receiving/transmitting terminal and a ground terminal of the radio frequency processing circuit (in a case where the radio frequency processing circuit uses the non-differential form of input/output), respectively.

Figure 9:
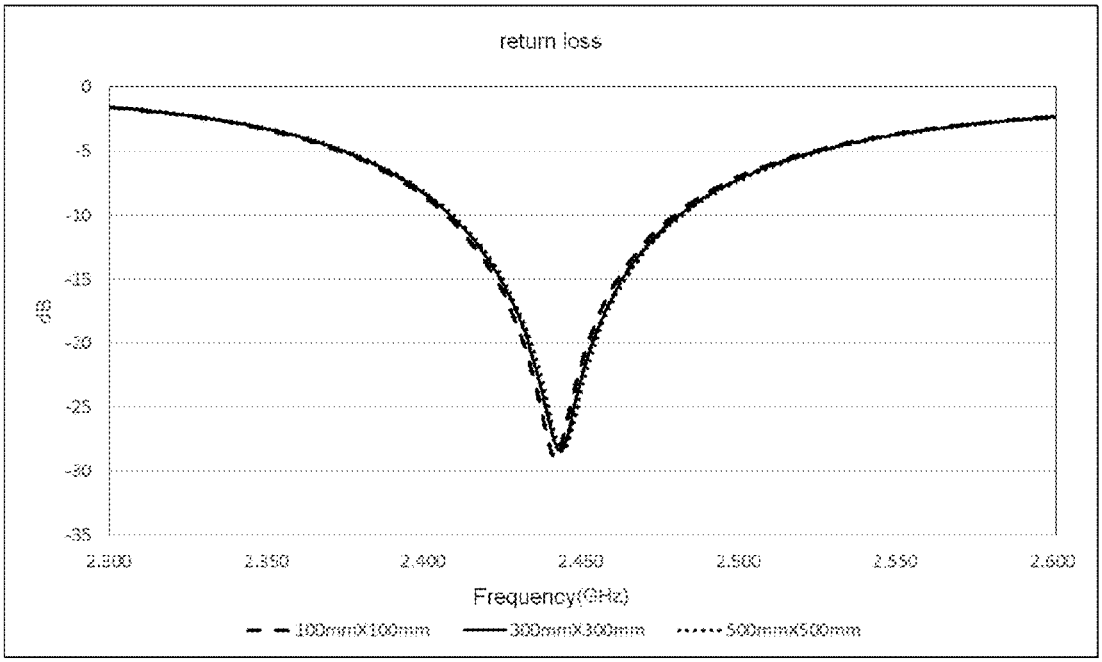
FIG. 9 shows return losses of the arc shaped folding dipole antenna of FIG. 8 when it is placed on the centers of the metal plates with different sizes.
Figure 10:
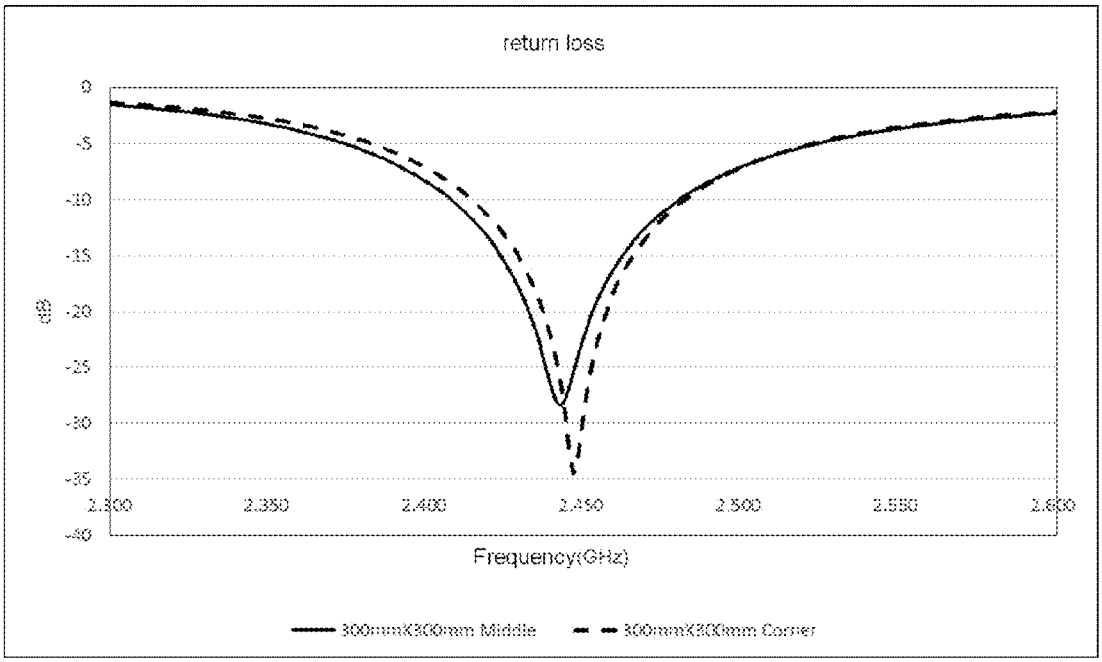
FIG. 10 shows return losses of the arc shaped folding dipole antenna of FIG. 8 when it is placed on different positions of the top of the metal housing with sizes of 300 mm×300 mm×300 mm.
Figure 11:
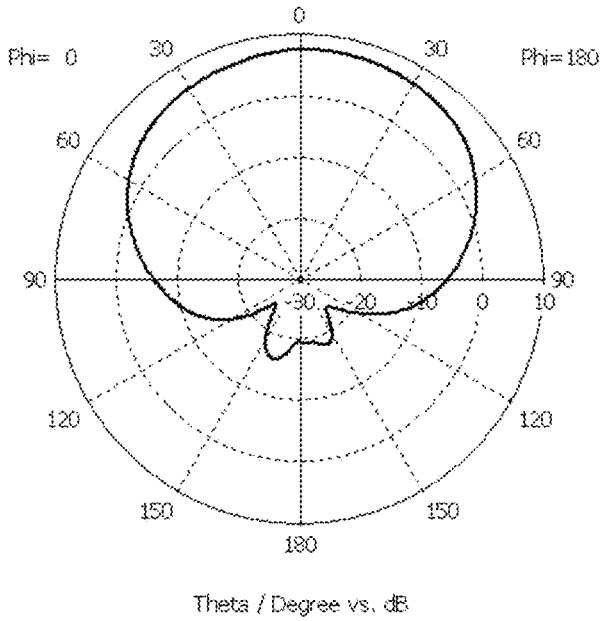
FIG. 11 is a diagram of a radiation direction of the arc shaped folding dipole antenna of FIG. 8 placed on the top center of the metal housing with sizes of 300 mm×300 mm×300 mm.
Figure 12:
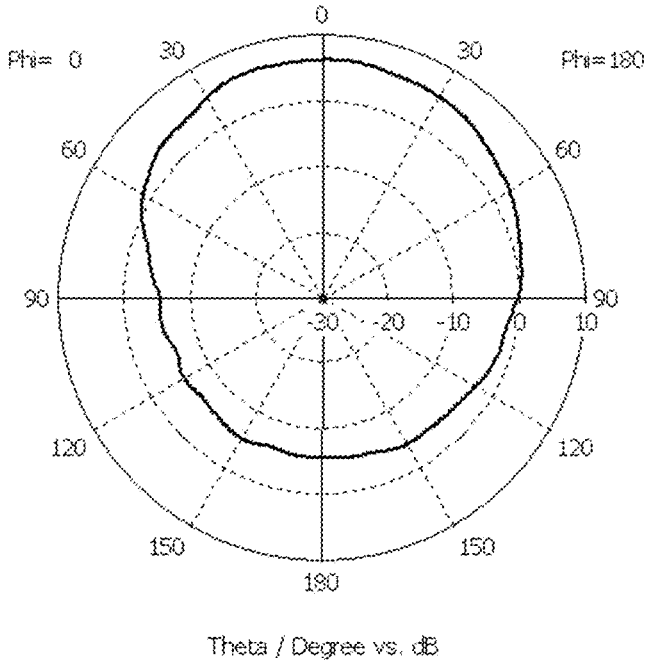
FIG. 12 is a diagram of a radiation direction of the arc shaped folding dipole antenna of FIG. 8 placed on the top corner of the metal housing with sizes of 300 mm×300 mm×300 mm.

FIGS. 9-12 show the performances of the wireless communication module of FIG. 7 and the folding dipole antenna of FIG. 8. FIG. 9 shows return losses of the arc shaped folding dipole antenna of FIG. 8 when it is placed on the centers of the metal plates with different sizes; FIG. 10 shows return losses of the arc shaped folding dipole antenna of FIG. 8 when it is placed on different positions of the top of the metal housing with sizes of 300 mm×300 mm×300 mm;

FIG. 11 show a radiation direction of the arc shaped folding dipole antenna of FIG. 8 placed on the top center of the metal housing with sizes of 300 mm×300 mm×300 mm, in which, the frequency point is 2.45 GHz, the gain is equal to 7.58 dB, and the 3 dB beam width is equal to 100.1 degrees. FIG. 12 shows a radiation direction of the arc shaped folding dipole antenna of FIG. 8 placed on the top corner of the metal housing with sizes of 300 mm×300 mm×300 mm, in which, the frequency point is 2.45 GHz, the gain is equal to 6.28 dB, and the 3 dB beam width is equal to 102.1 degrees. Compared with the IFA antenna shown in FIGS. 2 and 4, the matching characteristics of the antenna according to the embodiments of the present invention is less affected by the installation position of the antenna, as shown in FIGS. 9-10. Compared with the IFA antenna shown in FIGS. 5 and 6, the antenna according to the embodiments of the present invention may achieve excellent radiation performance, that is, a higher gain and a higher lobe ratio, as shown in FIGS. 11 and 12, when it installed on different positions of the metal housing.

Figure 13:
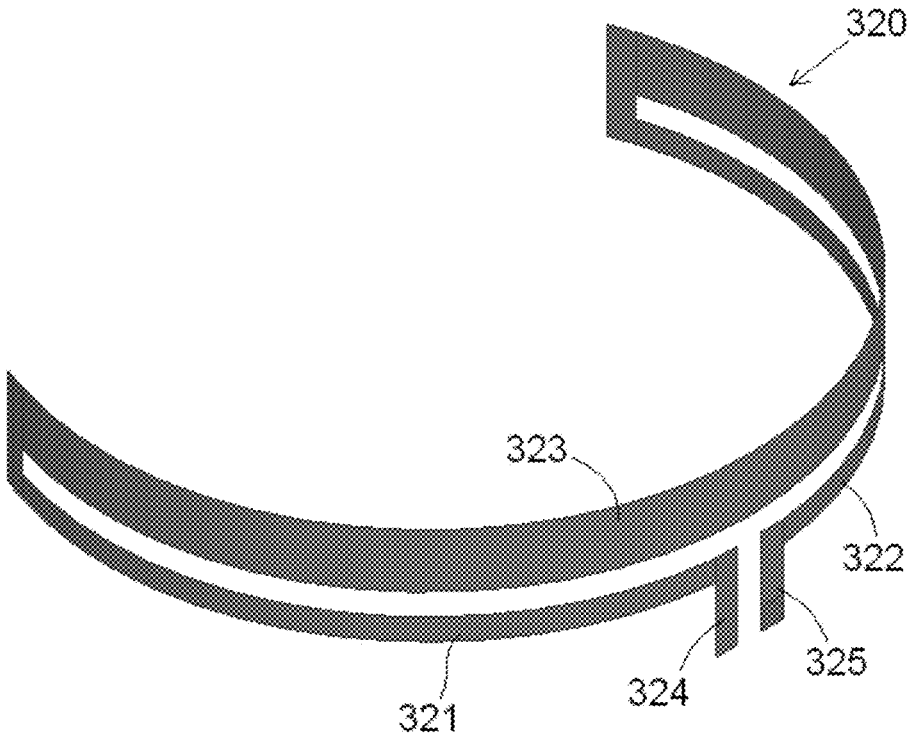
FIG. 13 shows another structure of an arc shaped folding dipole antenna.

The shape shown in FIG. 8 is only an example of a folding dipole antenna of the present invention and the present invention is not limited to this. For example, the folding dipole antenna 320 may have the shape shown in FIG. 13. As shown in FIG. 13, the composite structure (the lower arc) composed of the first conductor segment 321 and the second conductor segment 322 also exhibits an arc shape. The third conductor segment 323 (the upper arc) is located above the composite structure and overlapped with the composite structure in a direction perpendicular to a surface where the composite structure is located. In the embodiment shown in FIG. 8, the third conductor segment 223 is overlapped with (coplanar with) the composite structure in a direction perpendicular to the surface where the composite structure is located. Two metal pins (feed points or the above first and second feed conductors 324, 325) are provided to connect the first conductor segment 321 and the second conductor segment 322 to two radio frequency signal receiving/transmitting terminals of the radio frequency processing circuit, respectively.

However, in other embodiments, the third conductor segment 323 may not be coplanar with the composite structure, but parallel to each other. Similarly, the antenna input impedance may be varied with the changing of a width of the outer arc and the inner arc, a distance between them (or a length of the connection conductor segment), and a height of the arc surface relative to a ground surface thereof (for example, PCB below the arc surface in FIG. 9). Generally, those skilled in this art may design parameters according to specific requirements, so as to produce the antenna input impedance matched with an output impedance of a radio frequency processing circuit.

The arc shaped folding dipole antenna in the above embodiments has characteristics of good conformance on other components of the wireless communication module or modules, or less affects the spatial layout of the other components of the wireless communication module or modules. This makes the design of the wireless communication module and the integrated circuit more simple and convenient.

Also, the shape shown in FIGS. 8 and 13 is also an example of the folding dipole antenna of the present invention. According to the shape of the wireless communication module, the folding dipole antenna of the embodiments of the present invention may be flexibly designed into different shapes. For example, the folding dipole antenna 420, 520 of the embodiments of the present invention may be designed to have the shape shown in FIGS. 14 and 15.

Figure 14:
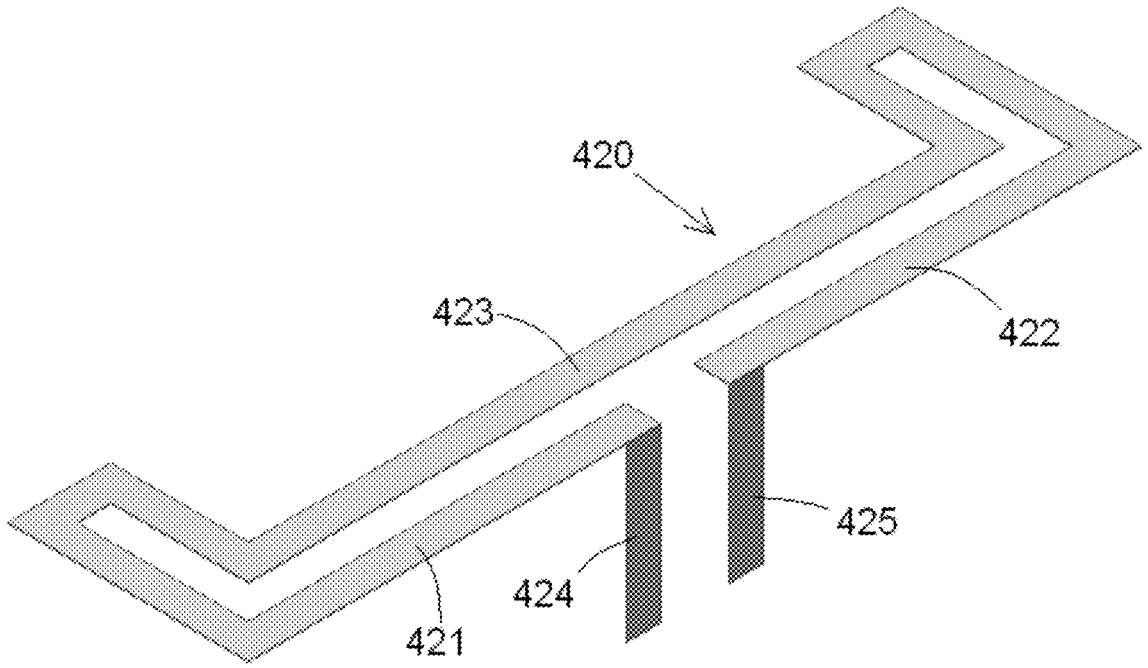
FIG. 14 is a view of a half I-shaped folding dipole antenna.

As shown in FIG. 14, in the folding dipole antenna 420, the composite structure composed of the first conductor segment 421 and the second conductor segment 422 exhibits a half I-shape (an outer half I-shaped segment). The third conductor segment 423 (an inner half I-shaped segment) is located in a recess defined by the composite structure and forms a hollow half I-shape together with the composite structure. Two metal pins (feed points or the above first and second feed conductors 424, 425) are provided to connect the first conductor segment 421 and the second conductor segment 422 to two radio frequency signal receiving/transmitting terminals of the radio frequency processing circuit, respectively.

Figure 15:
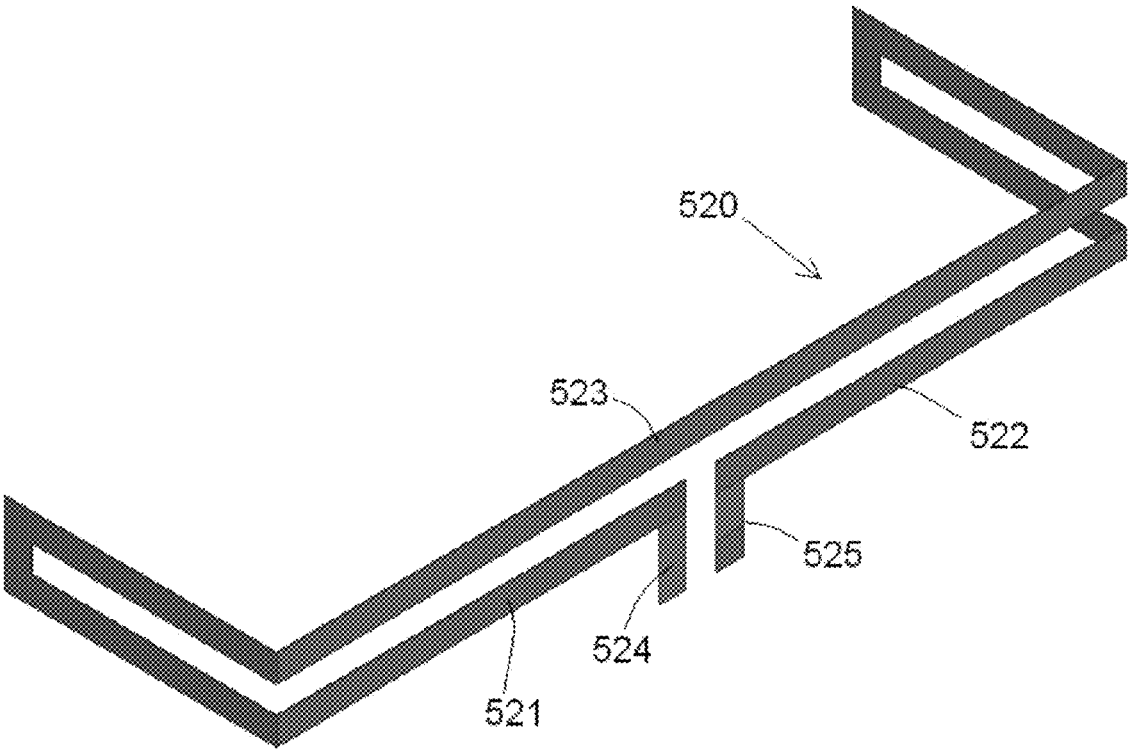
FIG. 15 is another view of a half I-shaped folding dipole antenna.

As shown in FIG. 15, in the folding dipole antenna 520, the composite structure composed of the first conductor segment 521 and the second conductor segment 522 exhibits a half I-shape (a lower half I-shaped segment), the third conductor segment 523 (an upper half I-shaped segment) is located above the composite structure and overlapped with (that is, coplanar with) the composite structure in a direction perpendicular to the surface where the composite structure is located. Two metal pins (feed points or the above first and second feed conductors 524, 525) are provided to connect the first conductor segment 521 and the second conductor segment 522 to two radio frequency signal receiving/transmitting terminals of the radio frequency processing circuit, respectively.

Similar as the arc shape, the third conductor segment may also be parallel to the composite structure but not in the same plane.

In the embodiments shown in FIGS. 14 and 15, the width of the third conductor segment is equal to that of the composite structure. However, in other embodiments, the width of the third conductor segment may be different from that of the composite structure.

Similarly, the antenna input impedance is varied with the changing of a width of the inner/outer half I-shaped segment (or the upper/lower half I-shaped segment), a distance between them (or a length of the connection conductor segment), and a height of the half I-shaped segment relative to a ground surface thereof (for example, PCB below the half I-shaped segment). Generally, those skilled in this art may design parameters according to specific requirements, so as to produce the antenna input impedance matched with an output impedance of a radio frequency processing circuit.

Thereby, the folding dipole antenna of the present invention may not be limited to the shapes shown in FIGS. 8, 13-15. The folding dipole antenna of the embodiments of the present invention may have any suitable shape as long as it uses a balanced antenna structure.

Figure 16:
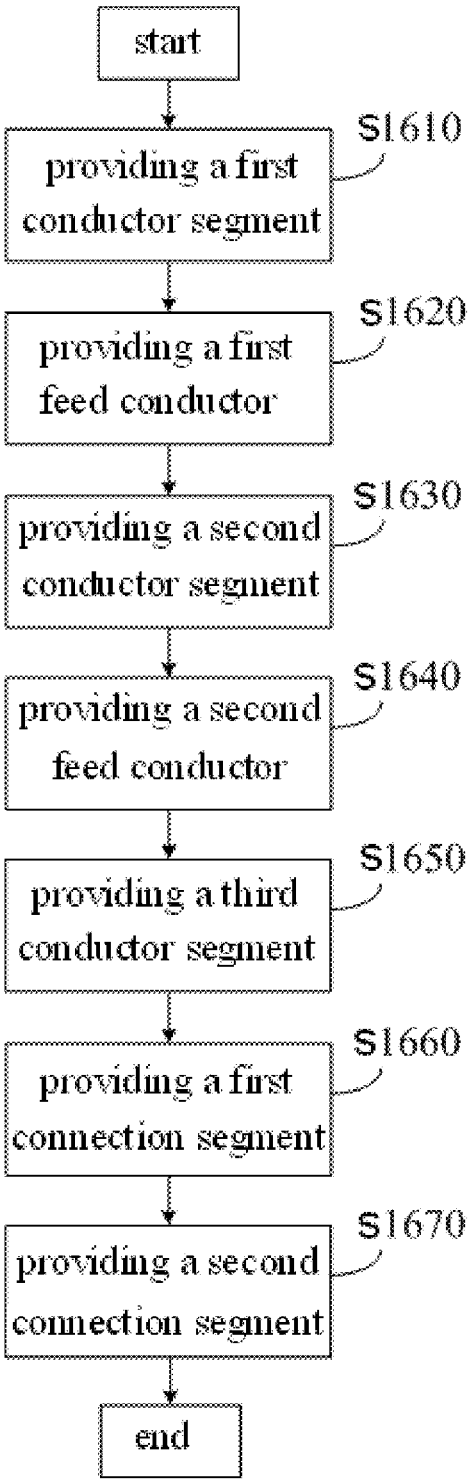
FIG. 16 is a flow chart showing a method of constructing a folding dipole antenna.

Shown in FIG. 16 is a flow chart showing a method of constructing a folding dipole antenna according to an embodiment of the present invention. In the embodiment shown in FIG. 16, the method mainly comprises the steps of:

providing a first conductor segment (S1610);

providing a first feed conductor, one end of which is connected to the first conductor segment (S1620), the other end of which is connected to a radio frequency signal receiving/transmitting terminal of a radio frequency processing circuit;

providing a second conductor segment with a length substantially equal to that of the first conductor segment (S1630);

providing a second feed conductor (S1640), one end of which is connected to the second conductor segment, the other end of which is connected to another radio frequency signal receiving/transmitting terminal or a ground terminal of the radio frequency processing circuit;

providing a third conductor segment (S1650);

providing a first connection segment configured to connect the first conductor segment and the third conductor segment (S1660); and providing a second connection segment configured to connect the second conductor segment and the third conductor segment (S1670).

The first connection segment is configured to have a length substantially equal to that of the second connection segment. The first conductor segment and the second conductor segment are separated by the first feed conductor and the second feed conductor. The third conductor segment is connected in series between the first conductor segment and the second conductor segment and parallel to a composite structure composed of the first conductor segment and the second conductor segment.

In some embodiments, as shown in FIG. 8, the composite structure may exhibit an arc shape. The third conductor segment 223 may be configured to be an outer arc that is concentric to the composite structure and has an arc sector angle substantially equal to that of the composite structure.

In some embodiments, as shown in FIG. 13, the composite structure exhibits an arc shape. The third conductor segment 323 is located above the composite structure and overlapped with or not overlapped with the composite structure in a direction perpendicular to the surface where the composite structure is located.

In some embodiments, as shown in FIG. 14, the composite structure may exhibit a half I-shape. The third conductor segment 423 is located in a recess defined by the composite structure and forms a hollow half I-shape together with the composite structure.

In some embodiments, as shown in FIG. 15, the composite structure may exhibit a half I-shape. The third conductor segment 523 is located above the composite structure and overlapped with or not overlapped with the composite structure in a direction perpendicular to the surface where the composite structure is located.

In the above embodiments of the antenna, a width of the composite structure, a width of the third conductor segment, a distance between the composite structure and the third conductor segment, a distance between the composite structure and a ground plane, and a distance between the third conductor segment and the ground plane are selected as required, so as to produce an antenna input impedance matched with an output impedance of the radio frequency processing circuit, so as to achieve the impedance matching.

It should be noted that the step number is only for ease of description of the embodiment of the invention and does not represent the actual implementation order. For example, firstly providing a first feed conductor (S1620); then providing the first conductor segment (S1610); providing the first connection segment (1660); providing the third conductor segment (S1650); providing the second connection segment (S1670); providing the second conductor segment (S1630); and finally providing the second feed conductor (S1640). In addition, those skilled in this art may implement the method in any other order. In some cases where the antenna is formed in a single processing, the above steps may be carried out simultaneously. Thereby, the present invention is not limited to the order shown in FIG. 16.

Figure 17:
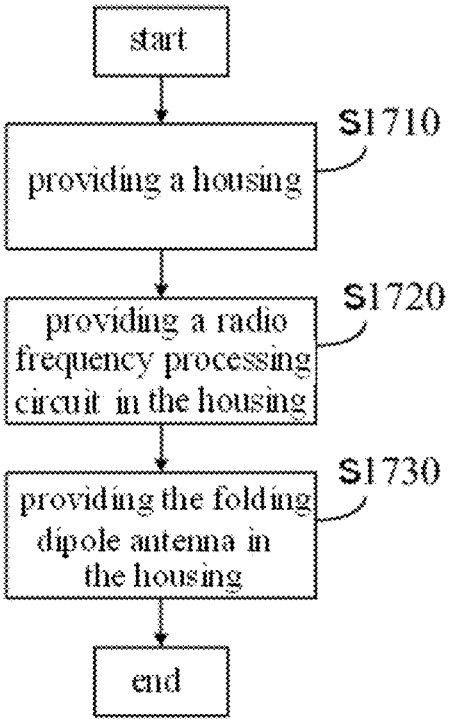
FIG. 17 is a flow chart showing a method of constructing a wireless communication module.

Also, as shown in FIG. 17, in an embodiment of the present invention, there is provided a method of constructing a wireless communication module. The method mainly comprises steps of:

providing a housing (S1710);

providing a radio frequency processing circuit in the housing (S1720); and providing the folding dipole antenna, constructed according to the solution shown in FIG. 16, in the housing (S1730), wherein the folding dipole antenna is connected to the radio frequency processing circuit.

Similarly, as described above, the present invention is not limited to the step order shown in FIG. 17.

The wireless communication module provided in the present invention has a balanced folding dipole antenna. Therefore, an induction current produced in adjacent metal in use is far less than the non-balanced antenna. As a result, its performance is less affected by the metal housing of the home appliance and has very high stability.

The wireless communication module with such antenna has good universality and may be installed on different positions of different outer surfaces of different home appliances while maintaining excellent performance, such as, low antenna return loss, high antenna efficiency and excellent radiation pattern. Also, it can meet the requirements of the home appliance of Internet of things, for example, small size and low profile of the wireless module.

It should be appreciated by those skilled in this art that the above embodiments are intended to be illustrative and not restrictive. For example, many modifications may be made to the above embodiments by those skilled in this art and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the invention, the scope of which is defined in the claims and their equivalents.

As used herein, an element recited in the singular and preceded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A folding dipole antenna, comprising:

a first feed conductor having an end thereof connected to a radio frequency signal receiving/transmitting terminal of a radio frequency processing circuit;

a first conductor segment connected to the other end of the first feed conductor;

a second feed conductor having an end thereof connected to another radio frequency signal receiving/transmitting terminal or a ground terminal of the radio frequency processing circuit;

a second conductor segment:

(a) having a length substantially equal to the first conductor segment, (b) separated from the first conductor segment by the first feed conductor and the second feed conductor, and (c) connected to an end of the second feed conductor;

a third conductor segment connected:

(a) in series between the first conductor segment and the second conductor segment, and (b) in parallel to a composite structure composed of the first conductor segment and the second conductor segment;

a first connection segment connecting the first conductor segment and the third conductor segment; and a second connection segment:

(a) connected to the second conductor segment and the third conductor segment, (b) having a length substantially equal to that of the first connection segment, and (c) separated from the first connection segment by the first feed conductor and the second feed conductor.

2. The folding dipole antenna according to claim 1, wherein the composite structure has an arc shape, the third conductor segment is an outer arc that is concentric to the composite structure and has an arc sector angle substantially equal to that of the composite structure.

3. The folding dipole antenna according to claim 2, wherein:

(a) the width of the composite structure, (b) the width of the third conductor segment, (c) the distance between the composite structure and the third conductor segment, (d) the distance between the composite structure and a ground plane, and (e) the distance between the third conductor segment and the ground plane are selected to produce an antenna input impedance matched with an output impedance of the radio frequency processing circuit.

4. The folding dipole antenna according to claim 1, wherein the composite structure has an arc shape, the third conductor segment is above the composite structure and overlapped with or not overlapped with the composite structure in a direction perpendicular to the surface where the composite structure is located.

5. A wireless communication module, comprising:

a housing;

a radio frequency processing circuit in the housing; and a folding dipole antenna in the housing and connected to the radio frequency processing circuit and comprising:

(a) a first feed conductor having an end thereof connected to a radio frequency signal receiving/transmitting terminal of a radio frequency processing circuit;

(b) a first conductor segment connected to the other end of the first feed conductor;

(c) a second feed conductor having an end thereof connected to another radio frequency signal receiving/transmitting terminal or a ground terminal of the radio frequency processing circuit;

(d) a second conductor segment:

(1) having a length substantially equal to the first conductor segment, (2) separated from the first conductor segment by the first feed conductor and the second feed conductor, and (3) connected to an end of the second feed conductor;

(e) third conductor segment connected:

(1) in series between the first conductor segment and the second conductor segment, and (2) in parallel to a composite structure composed of the first conductor segment and the second conductor segment;

(f) a first connection segment connecting the first conductor segment and the third conductor segment; and (g) a second connection segment:

(1) connected to the second conductor segment and the third conductor segment, (2) having a length substantially equal to that of the first connection segment, and (3) separated from the first connection segment by the first feed conductor and the second feed conductor.

6. A method of constructing a folding dipole antenna, comprising steps of:

providing a first feed conductor having an end thereof connected to the first conductor segment;

providing a first conductor segment having an end thereof connected to a radio frequency signal receiving/transmitting terminal of a radio frequency processing circuit;

providing a second feed conductor with one end thereof connected to the second conductor segment and the other end thereof connected to another radio frequency signal receiving/transmitting terminal or a ground terminal of the radio frequency processing circuit;

providing a second conductor segment:

(a) having a length substantially equal to that of the first conductor segment, and (b) separated from the first conductor segment by the first feed conductor and the second feed conductor;

providing a third conductor segment connected in series between the first conductor segment and the second conductor segment and in parallel to a composite structure composed of the first conductor segment and the second conductor segment;

providing a first connection segment configured to connect the first conductor segment and the third conductor segment; and providing a second connection segment configured to connect the second conductor segment and the third conductor segment and the second connection segment is configured to have a length substantially equal to that of the first connection segment.

7. The method according to claim 6, wherein the composite structure is an arc shape, the third conductor segment is an outer arc that is concentric to the composite structure and has an arc sector angle substantially equal to that of the composite structure.

8. The method according to claim 7, wherein:

(a) the width of the composite structure, the width of the third conductor segment, (b) the distance between the composite structure and the third conductor segment, (c) the distance between the composite structure and a ground plane, and (d) the distance between the third conductor segment and the ground plane are selected to produce an antenna input impedance matched with an output impedance of the radio frequency processing circuit.

9. The method according to claim 6, wherein the composite structure is an arc shape, the third conductor segment is above the composite structure and overlapped with or not overlapped with the composite structure in a direction perpendicular to the surface where the composite structure is located.

10. A method of constructing a folding dipole antenna, comprising steps of:

providing a housing;

providing a radio frequency processing circuit;

providing a dipole antenna having:

(a) first feed conductor having an end thereof connected to the first conductor segment, (b) a first conductor segment having an end thereof connected to a radio frequency signal receiving/transmitting terminal of a radio frequency processing circuit, (c) a second feed conductor with one end thereof connected to the second conductor segment and the other end thereof connected to another radio frequency signal receiving/transmitting terminal or a ground terminal of the radio frequency processing circuit, (d) a second conductor segment:

(1) having a length substantially equal to that of the first conductor segment, and (2) separated from the first conductor segment by the first feed conductor and the second feed conductor, (e) a third conductor segment connected in series between the first conductor segment and the second conductor segment and in parallel to a composite structure composed of the first conductor segment and the second conductor segment, (f) a first connection segment configured to connect the first conductor segment and the third conductor segment, and (g) a second connection segment configured to connect the second conductor segment and the third conductor segment and the second connection segment is configured to have a length substantially equal to that of the first connection segment;

connecting the folding dipole antenna to the radio frequency processing circuit; and placing the radio frequency processing circuit and the dipole antenna in the housing.

11. A folding dipole antenna, comprising:

a first feed conductor having an end thereof connected to a radio frequency signal receiving/transmitting terminal of a radio frequency processing circuit;

a first conductor segment connected to the other end of the first feed conductor;

a second feed conductor having an end thereof connected to another radio frequency signal receiving/transmitting terminal or a ground terminal of the radio frequency processing circuit;

a second conductor segment:

(a) having a length substantially equal to the first conductor segment, (b) separated from the first conductor segment by the first feed conductor and the second feed conductor, and (c) connected to an end of the second feed conductor;

a third conductor segment:

(a) connected in series between the first conductor segment and the second conductor segment, (b) connected in parallel to a composite structure having a half I-shape and composed of the first conductor segment and the second conductor segment, (c) in a recess defined by the composite structure, and (d) forming a hollow half I-shape together with the composite structure;

a first connection segment connecting the first conductor segment and the third conductor segment; and a second connection segment:

(a) connected to the second conductor segment and the third conductor segment, (b) having a length substantially equal to that of the first connection segment, and (c) separated from the first connection segment by the first feed conductor and the second feed conductor.

12. The folding dipole antenna according to claim 11, wherein the composite structure is a half I-shape and the third conductor segment is above the composite structure and overlapped with or not overlapped with the composite structure in a direction perpendicular to the surface where the composite structure is located.

13. A method of constructing a folding dipole antenna, comprising steps of:

providing a first feed conductor having an end thereof connected to the first conductor segment;

providing a first conductor segment having an end thereof connected to a radio frequency signal receiving/transmitting terminal of a radio frequency processing circuit;

providing a second feed conductor with one end thereof connected to the second conductor segment and the other end thereof connected to another radio frequency signal receiving/transmitting terminal or a ground terminal of the radio frequency processing circuit;

providing a second conductor segment:

(c) having a length substantially equal to that of the first conductor segment, and (d) separated from the first conductor segment by the first feed conductor and the second feed conductor;

providing a third conductor segment connected in series between the first conductor segment and the second conductor segment and in parallel to a composite structure that is a half I-shape and composed of the first conductor segment and the second conductor segment;

providing a first connection segment configured to connect the first conductor segment and the third conductor segment; and providing a second connection segment configured to connect the second conductor segment and the third conductor segment with the second connection segment configured to have a length substantially equal to that of the first connection segment and the third conductor segment is in a recess defined by the composite structure and forms a hollow half I-shape together with the composite structure.

14. The method according to claim 13, wherein the composite structure is a half I-shape, the third conductor segment is and overlapped with or not overlapped with the composite structure in a direction perpendicular to the surface where the composite structure is located.

* * * * *